US007905430B1

(12) United States Patent
Kumar

(10) Patent No.: US 7,905,430 B1
(45) Date of Patent: Mar. 15, 2011

(54) SPRAY SYSTEM

(76) Inventor: Sivathanu B. Kumar, Tampa, FL (US)

( * ) Notice: Subject to any disclaimer, the term of this patent is extended or adjusted under 35 U.S.C. 154(b) by 435 days.

(21) Appl. No.: 12/150,051

(22) Filed: Apr. 24, 2008

Related U.S. Application Data

(60) Provisional application No. 61/011,657, filed on Jan. 20, 2008.

(51) Int. Cl.
*B05B 7/32* (2006.01)

(52) U.S. Cl. ..... 239/337; 239/274; 239/288; 239/289; 239/600; 222/402.13; 222/402.15; 222/473

(58) Field of Classification Search ..... 239/274, 239/288–288.5, 289, 337, 578, 600; 222/402.1, 222/402.13, 402.15, 323, 473
See application file for complete search history.

(56) References Cited

U.S. PATENT DOCUMENTS 3,045,878 A * 7/1962 Blanford et al. ..... 222/473
4,579,258 A * 4/1986 Brown et al. ..... 222/402.15
5,318,208 A * 6/1994 van der Wal ..... 222/402.13
6,029,862 A * 2/2000 Jones ..... 222/402.15

* cited by examiner

*Primary Examiner* — Steven J Ganey

(57) ABSTRACT

A housing is formed of a peripheral wall, an upper face and a lower edge. The housing is positionable upon a spray container. The housing has securing members holding the housing to a spray container. A dispensing assembly has projections. The dispensing assembly has aligned apertures. The dispensing assembly has a rotatable member. The rotatable member has a linear region. The rotatable member is received in the aligned apertures. The dispensing assembly has a handle extending from the linear region to a location spaced from a container. The dispensing assembly also has a planar arm secured to the linear region. The arm has a threaded aperture a threaded adjustment bolt. The bolt is rotatably received in the threaded aperture. The adjustment bolt has a lower tip in contact with a head for the depressing of a head and dispensing of contents from a container upon squeezing of the handle.

7 Claims, 2 Drawing Sheets

FIG 1
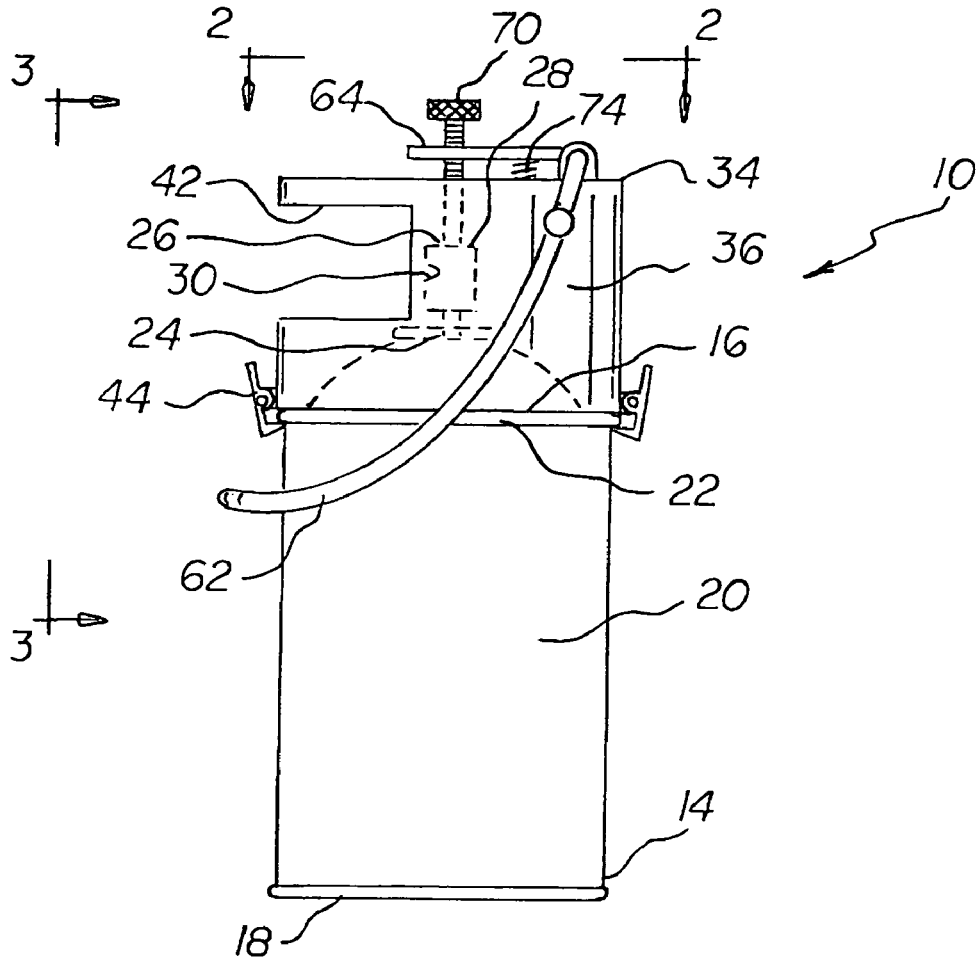
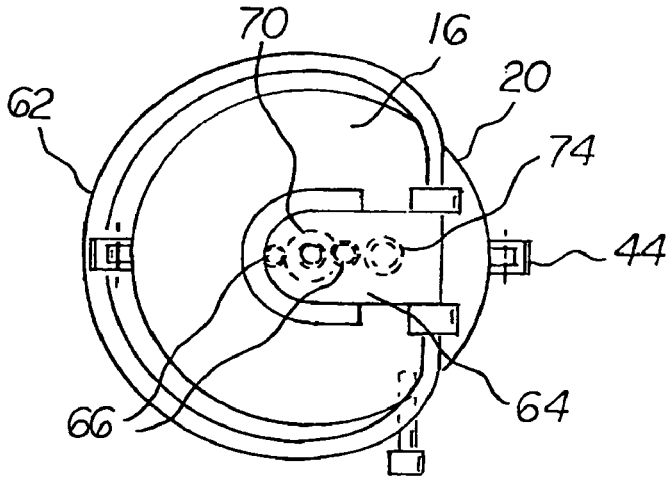
FIG 2

FIG 3
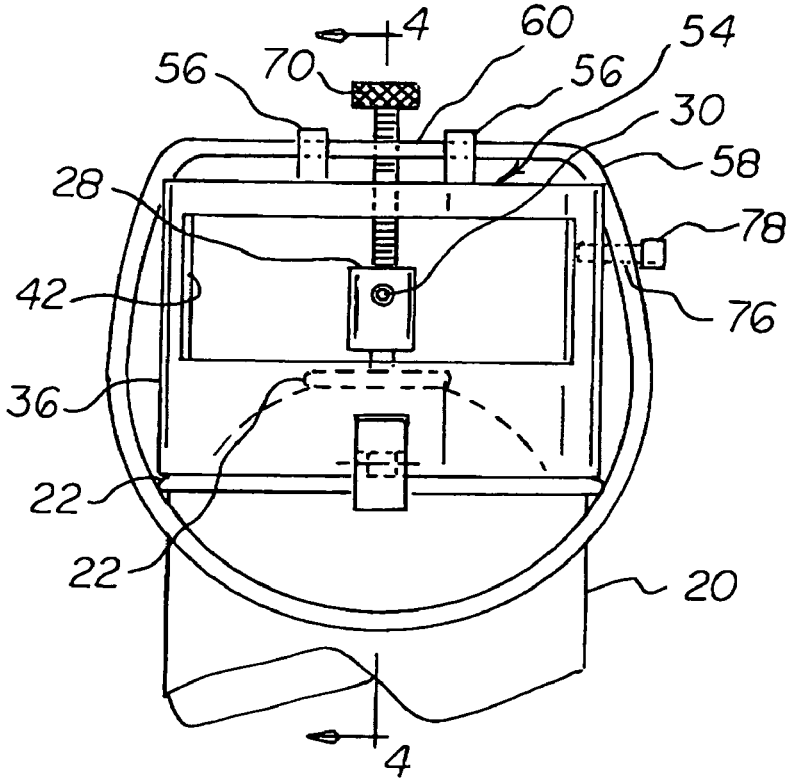
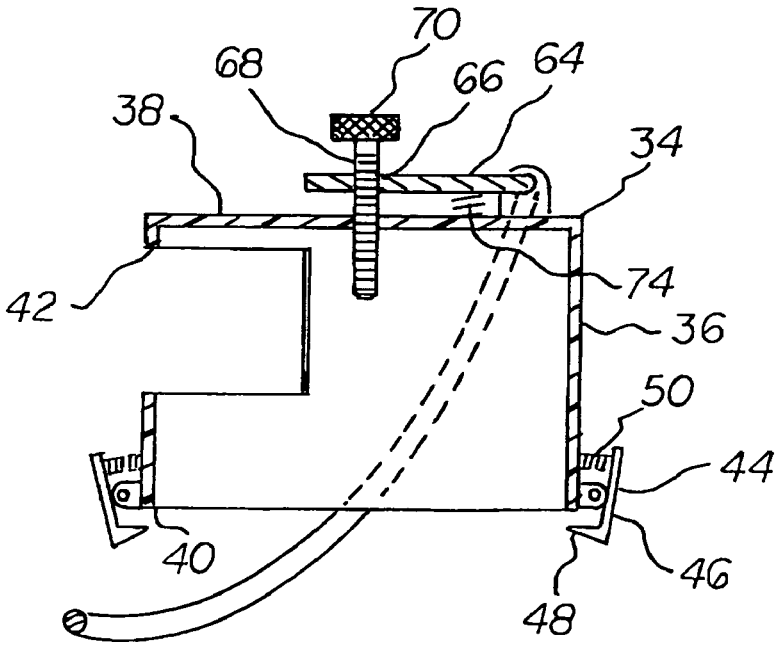
FIG 4

SPRAY SYSTEM

RELATED APPLICATION

The present application is based upon U.S. Provisional Application No. 61/011,657 filed Jan. 20, 2008, the subject matter of which is incorporated herein by reference.

BACKGROUND OF THE INVENTION

1. Field of the Invention

The present invention relates to a spray system and more particularly pertains to dispensing contents of a container in a safe, convenient and economical manner while reducing finger stress and fatigue caused by continuous spraying. This invention allows the spraying to be accomplished by the simultaneous use of one or more fingers or alternating between fingers and thus further reducing the stress and fatigue. Holding and supporting the weigh of the container close to the center of gravity of the container reduces the stress and fatigue of the wrist and hand for the operator and improves maneuverability.

2. Description of the Prior Art

In this respect, the present invention substantially departs from the conventional concepts and designs of the prior art, and in doing so provides an apparatus primarily developed for the purpose of dispensing contents of a container in a safe, convenient and economical manner.

Therefore, it can be appreciated that there exists a continuing need for a new and improved spray system which can be used for dispensing contents of a container in a safe, convenient and economical manner and reducing finger fatigue for the user. This invention allows the spraying to be accomplished by the simultaneous use of one or more fingers or alternating between fingers and thus further reducing the stress and fatigue. Holding and supporting the weigh of the container close to the center of gravity of the container reduces the stress and fatigue of the wrist and hand for the operator and improves maneuverability. In this regard, the present invention substantially fulfills this need.

SUMMARY OF THE INVENTION

In view of the disadvantages inherent in the known types of spray systems of known designs and configurations now present in the prior art, the present invention provides an improved spray system. As such, the general purpose of the present invention, which will be described subsequently in greater detail, is to provide a new and improved spray system and method which has all the advantages of the prior art and none of the disadvantages.

To attain this, the present invention essentially comprises a spray system. First provided is a container. The container has a top. The container has a bottom. The container has a side wall. The side wall is provided between the top and the bottom. The container has an interior chamber. The interior chamber receives contents under pressure to be dispensed. The container has an annular ring. The annular ring is provided on adjacent to the top. The container has an aperture. The aperture is provided in the top. The container has a head. The head is reciprocably co-operable with the aperture. The head has an upper surface to be depressed. The container has a passageway. The passageway extends between a lateral extent of the head and the chamber. In this manner contents are contents are dispensed from the chamber upon depressing the head.

A housing or adaptor is provided next. The housing has a peripheral wall. The housing has a upper face. The housing has a lower edge. The lower edge is positioned upon the side wall adjacent to the top. The peripheral wall has an opening. The opening is provided adjacent to the passageway. In this manner movement of contents of the container to exterior of the system is allowed. The housing has a plurality of securing members. The securing members are pivotally secured to the peripheral wall. Each securing member has a finger. Each finger has an inwardly extending tip. The tip is movable between an operative locking position beneath the annular ring and an inoperative unlocking position with the tip remote from the angular ring. The operative locking position holds together the housing and the container. The inoperative unlocking position removes the housing from the container. Each finger has an associated spring means. The spring means urges an associated tip into an operative position. The securement members and annular ring are preferably adjustable for use with containers of various sizes.

Provided last is a dispensing assembly. The dispensing assembly includes upstanding projections. The upstanding projections are provided on the upper face of the housing. The upstanding projections have axially aligned apertures. The dispensing assembly includes a rotatable member. The rotatable member has a linear region. The linear region is received in the aligned apertures. The dispensing assembly includes a handle. The handle is preferably provided in a curved configuration. The handle extends from the linear region to a location spaced from and partially encompassing the side wall of the container. The dispensing assembly includes a planar arm. The planar arm is secured to the linear region of the rotatable member, the planar arm having threaded apertures above the head. The dispensing assembly includes a threaded adjustment bolt adjustable horizontally and vertically in relation to the head of the container. The bolt is rotatably received in a threaded aperture above the head. The bolt has an enlargement. The enlargement is provided at an upper end of the bolt. The bolt has a tip. The tip is provided at a lower end of the bolt. The tip of the bolt is in contact with the head. In this manner the head may be depressed. Further in this manner contents may be dispensed from the container. The dispensing member includes a resilient member. The resilient member is located between the planar arm and the upper face of the housing. The resilient member urges the planar arm and adjustment bolt away from the head and to adjust the tension for proper function and feel for the user. A locking mechanism is provided. The locking mechanism includes a threaded hole. The threaded hole is provided in an intermediate extent of the handle. The locking mechanism includes a threaded member. The threaded member extends through the threaded hole for contacting the side wall of the housing. In this manner inadvertent movement of the handle is precluded.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved spray system which has all of the advantages of the prior art spray systems of known designs and configurations and none of the disadvantages and the advantage of reducing finger stress and strain caused by continuous spraying.

It is another object of the present invention to provide a new and improved spray system which may be easily and efficiently manufactured and marketed.

It is further object of the present invention to provide a new and improved spray system which is of durable and reliable constructions.

An even further object of the present invention is to provide a new and improved spray system which is susceptible of a low cost of manufacture with regard to both materials and labor, and which accordingly is then susceptible of low prices of sale to the consuming public, thereby making such spray system economically available to the buying public.

Even still another object of the present invention is to provide a spray system for dispensing contents of a container in a safe, convenient and economical manner and reducing finger stress and fatigue caused by continuous spraying for the user.

Lastly, it is an object of the present invention to provide a new and improved spray system. A housing is formed of a peripheral wall, an upper face and a lower edge. The housing is positionable upon a spray container. The housing has securing members holding the housing to a spray container. A dispensing assembly has projections. The dispensing assembly has aligned apertures. The dispensing assembly has a rotatable member. The rotatable member has a linear region. The rotatable member is received in the aligned apertures. The dispensing assembly has a handle extending from the linear region to a location spaced from a container. The dispensing assembly also has a planar arm secured to the linear region. The arm has a threaded aperture a threaded adjustment bolt. The bolt is rotatably received in the threaded aperture. The adjustment bolt has a lower tip in contact with a head for the depressing of a head and dispensing of contents from a container upon squeezing of the handle by a user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the primary and preferred embodiment of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a side elevational view of a spray system constructed in accordance with the principles of the present invention.

FIG. 2 is a plan view of the spray system taken along line 2-2 of FIG. 1.

FIG. 3 is a front elevational view of the upper extent of the spray system taken along line 3-3 of FIG. 1.

FIG. 4 is a cross sectional view taken along line 4-4 of FIG. 3.

The same reference numerals refer to the same parts throughout the various Figures.

DESCRIPTION OF THE PREFERRED EMBODIMENT

With reference now to the drawings, and in particular to FIG. 1 thereof, the preferred embodiment of the new and improved spray system embodying the principles and concepts of the present invention and generally designated by the reference numeral 10 will be described.

The present invention, the spray system 10 is comprised of a plurality of components. Such components in their broadest context include a housing and a dispensing assembly. Such components are individually configured and correlated with respect to each other so as to attain the desired objective.

First provided is a container 14. The container has a top 16. The container has a bottom 18. The container has a side wall 20. The side wall is provided between the top and the bottom. The container has an interior chamber. The interior chamber receives contents under pressure to be dispensed. The container has an annular ring 22. The annular ring is provided adjacent to the top. The container has an aperture 24. The aperture is provided in the top. The container has a head 26. The head is reciprocably co-operable with the aperture. The head has an upper surface 28 to be depressed. The container has a passageway 30. The passageway extends between a lateral extent of the head and the chamber. In this manner contents are contents are dispensed from the chamber upon depressing the head.

A housing 34 is provided next. The housing has a peripheral wall 36. The housing has a circular upper face 38. The housing has a lower edge 40. The lower edge is positioned upon the side wall adjacent to the top. The peripheral wall has an opening 42. The opening is provided adjacent to the passageway 30. In this manner movement of contents of the container to exterior of the system is allowed. The housing has a plurality of securing members 44. The securing members are pivotally secured to the peripheral wall adjacent to the edge. Each securing member has a finger 46. Each finger has an inwardly extending tip 48. The tip is movable between an operative locking position beneath the annular ring and an inoperative unlocking position with the tip remote from the angular ring. The operative locking position holds together the housing and the container. The inoperative unlocking position facilitates removal of the housing from the container. Each finger has an associated coil spring 50. The coil spring urges an associated tip into an operative position. The securement members and annular ring are preferably adjustable for use with containers of various sizes.

Provided last is a dispensing assembly 54. The dispensing assembly includes upstanding projections 56. The upstanding projections are provided on the upper face of the housing. The upstanding projections have axially aligned apertures. The dispensing assembly includes a rotatable member 58. The rotatable member has a linear region 60. The linear region is received in the aligned apertures. The dispensing assembly includes a handle 62. The handle is provided, preferably in a curved configuration. The handle extends from the linear region to a location spaced from and partially encompassing the side wall of the container. The dispensing assembly includes a planar arm 64. The planar arm is secured to the linear region of the rotatable member, the planar arm having threaded apertures 66 above the head. The dispensing assembly includes a threaded adjustment bolt 68. The bolt is rotatably received in a treaded aperture above the head. The bolt has an enlargement 70. The enlargement is provided at an upper end of the bolt. The bolt has a tip 72. The tip is provided at a lower end of the bolt. The tip of the bolt is in contact with the head. In this manner the head may be depressed. Further in this manner contents may be dispensed from the container. The dispensing member includes a resilient member 74. The resilient member is located between the planar arm and the upper face of the housing. The resilient member urges the planar arm and adjustment bolt away from the head and allows for the adjustment of the tension, feel and function. A locking mechanism is provided. The locking mechanism includes a threaded hole 76. The threaded hole is provided in an intermediate extent of the handle. The locking mechanism includes a threaded member 78. The threaded member extends through the threaded hole for contacting the side wall of the container. In this manner inadvertent movement of the handle is precluded.

The present invention is a device that is used in conjunction with and/or for modifying a spray container for the spraying of the content contained in that spray container. The use of this device relocates the controls and the direction of force required for the operation of spraying functions of a spray container and places the controls which are situated at an unfavorable over the top spray nozzle head location to a more favorable location allowing for ease of operation and reducing finger stress and fatigue caused by continuous spraying for the operator. The invention is purported to decrease the amount of force and effort required by the operator during the spraying function of the spay container. The invention reduces the stress and fatigue caused by continuous spraying and to ultimately improve the quality of the spray.

The pressure of the contents contained in the spray container varies and also the texture and the consistency of the contents contained in the spray container may vary. It is within the scope of this invention to design, modify, add to, and/or improve the location and designs of the components of this invention for convenience and performance and to optimize gas and fluid dynamics to adapt to such variations.

It is within the scope of this invention that this device in part or as a whole be incorporated and/or combined as an integral component of other devices or objects such as but not limited to a spray container and other objects or devices such as but not limited to a spray container in part or as a whole be incorporated and/or combined as a component of this invention.

It is within the scope of the invention to modify the components maintaining the primary scope and spirit of this invention.

The invention can be combined with other objects such as a spray container to form as one unit. One or more components of the invention can be incorporated as one or more components of another object or device such as the spray container and vice versa.

It is within the scope of this invention that one or more of the components and/or individual members of this invention be combined, added, omitted or modified.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A spray system comprising:

a spray container having a head;

a housing formed of a peripheral wall with an upper face and a lower edge positionable upon the spray container, the housing having securing members for holding the housing to the spray container; and a dispensing assembly having projections on the upper face of the housing with aligned apertures, the dispensing assembly also having a rotatable member with a linear region received in the aligned apertures and with a handle extending from the linear region to a location spaced from the spray container, the dispensing assembly also having a planar arm secured to the linear region, the planar arm having a threaded aperture above the head of the spray container with a threaded adjustment bolt rotatably received in the threaded aperture, the adjustment bolt having a lower tip in contact with the head for the depressing of the head and dispensing of contents from the spray container upon squeezing of the handle.

2. The system as set forth in claim 1 and further including:

an opening in the peripheral wall adjacent to the a head of the spray container for allowing movement of contents of the spray container to exterior of the system.

3. The system as set forth in claim 1 and further including:

a resilient member located between the planar arm and the upper face of the housing urging the planar arm and adjustment bolt away from the head to terminate spraying and for varying tension to maximize comfort and spraying quality.

4. The system as set forth in claim 1 and further including:

a locking mechanism including a threaded hole in an intermediate extent of the handle with a threaded member extending through the threaded hole for contacting a side wall of a housing to preclude inadvertent movement of the handle.

5. The system as set forth in claim 1 wherein the spray container has a top and a bottom with a side wall between the top and the bottom, the spray container having an interior chamber for the receipt of fluid contents under pressure to be dispensed, the spray container including annular rings on the side wall adjacent to the top, the container having an aperture in the top with the head reciprocably co-operable with the aperture, the head having an upper surface to be depressed with a passageway extending between a lateral extent of the head and the chamber to dispense contents from the chamber upon moving the handle towards the spray container thereby depressing the head.

6. The system as set forth in claim 1 wherein the securement means includes a plurality of securing components pivotally secured to the peripheral wall adjacent to the edge, each securing component having, a finger with an inwardly extending tip movable between an operative locking position beneath the annular rings for holding together the housing and the container of various sizes and an inoperative unlocking position with the tip remote from the annular ring for removing the housing from the container, each finger having an associated coil spring urging an associated tip into an operative position.

7. A spray system for dispensing contents of a container in a safe, convenient and economical manner and reducing finger stress and fatigue caused by continuous spraying comprising, in combination:

a container having a circular top and a circular bottom with a cylindrical side wall between the top and the bottom, the container having an interior chamber for the receipt of fluid contents under pressure to be dispensed, annular rings on the side wall adjacent to the top, the container having an aperture in the top with a head, reciprocably co-operable with the aperture, the head having an upper surface to be depressed with a passageway extending between a lateral extent of the head and the chamber to dispense contents from the chamber upon depressing the head;

a housing formed of a peripheral wall with an upper face and a lower edge positioned upon the side wall adjacent to the top, the peripheral wall having an opening adjacent to the passageway for allowing movement of contents of the container to exterior of the system, the housing having a plurality of securing members pivotally secured to the peripheral wall adjacent to the lower edge, each securing member having a finger with an inwardly extending tip movable between an operative locking position beneath the annular ring for holding together the housing and the container and an inoperative unlocking position with the tip remote from the annular ring for removing the housing from the container, each finger having an associated coil spring urging an associated tip into an operative position; and a dispensing assembly including a pair of upstanding projections on the upper face of the housing with axially aligned apertures, a rotatable member having a linear region received in the aligned apertures and a handle extending from the linear region to a location spaced from and partially encompassing the side wall of the container, a planar arm secured to the linear region of the rotatable member, the planar arm having threaded apertures above the head, a threaded adjustment bolt rotatably received in the threaded aperture with an enlargement at an upper end of the bolt and a tip at a lower end of the bolt in contact with the head for the depressing of the head and dispensing of contents from the container, a resilient member located between the planar arm and the upper face of the housing urging the planar arm and adjustment bolt away from the head and adjusting tension, the bolt being adjustably horizontally and vertically in relation to the head of the container, a locking mechanism including a threaded hole in an intermediate extent of the handle with a threaded member extending through the threaded hole for contacting the side wall of the container to preclude inadvertent movement of the handle.

* * * * *